United States Patent [19]

Desmond et al.

[11] Patent Number: 4,485,922

[45] Date of Patent: Dec. 4, 1984

[54] TRAY FOR CARDED PRODUCTS

[75] Inventors: John D. Desmond, Philadelphia, Pa.; Barbara M. Feirman, Forest Hills, N.Y.

[73] Assignee: Container Corporation of America, Chicago, Ill.

[21] Appl. No.: 571,384

[22] Filed: Jan. 17, 1984

[51] Int. Cl.[3] ..... B65D 1/34; B65D 5/50

[52] U.S. Cl. ..... 206/485; 206/45.19; 206/564; 229/34 HW

[58] Field of Search ..... 206/485, 562, 563, 564, 206/45.19, 45.14, 425, 455, 456; 229/34 HW, 23 A

[56] References Cited

U.S. PATENT DOCUMENTS

| | | | |
|---|---|---|---|
| 2,306,624 | 12/1942 | Harris | 206/485 |
| 2,964,175 | 12/1960 | Holte | 229/34 HW |
| 3,009,622 | 11/1961 | Leone | 206/45.19 |
| 3,302,776 | 2/1967 | Sparks | 206/564 |
| 3,302,777 | 2/1967 | Sparks | 206/45.14 |
| 3,314,530 | 4/1967 | Michalka | 206/45.14 |
| 3,856,137 | 12/1974 | Brindley | 206/564 |
| 3,927,761 | 12/1975 | Boyle | 206/485 |

FOREIGN PATENT DOCUMENTS

| | | | |
|---|---|---|---|
| 77663 | 2/1962 | France | 206/563 |
| 2344254 | 10/1977 | France | 206/45.14 |

*Primary Examiner*—William T. Dixson, Jr.
*Assistant Examiner*—Brenda J. Ehrhardt
*Attorney, Agent, or Firm*—Richard W. Carpenter

[57] ABSTRACT

A tray structure for holding a plurality of carded packages and including an internal partition structure with raised portions for cushioning the product and notches for receiving portions of the packaging card.

5 Claims, 3 Drawing Figures

TRAY FOR CARDED PRODUCTS

BACKGROUND OF THE INVENTION

1. Field of the Invention

This invention relates generally to folding cartons, and more particularly to a one-piece, tray-type carton having an integral, internal partition structure adapted to hold and maintain carded packages firmly in place.

2. Description of the Prior Art

A prior art search in the U.S. Patent and Trademark Office directed to the subject matter of this application disclosed the following patents: U.S. Pat. Nos. 1,081,068; 1,616,047; 1,892,349; 1,906,622; 2,038,845; 2,306,624; 2,334,985; 2,431,535; 2,829,767; 2,980,241; 3,009,622; 3,302,776; 3,508,484; 3,856,137; 4,025,039; 4,029,208; 4,043,451; 4,143,763 and Swedish Pat. No. 101,434.

None of the prior art patents uncovered in the search discloses a tray and partition structure including cushioning means in the lower portion of the tray combined with slots in certain panels of the structure which stabilize the carded packages held by the tray.

SUMMARY OF THE INVENTION

It is an object of the present invention to provide a tray with integral internal partitions structure adapted to hold a plurality of carded packages in an upright position.

A more specific object of the invention is the provision, in a tray of the type described, of an internal partition adapted to cushion the articles held in the carded packages and permit the cards of the packages to extend all the way to the bottom wall panel of the tray to stabilize the packages and maintain them in parallel upright position.

A more specific object of the invention is the provision of a partition structure for a tray which includes raised central portions cushioning the product held by the carded packages and slots receiving lower portions of the cards of the carded packages.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 2:
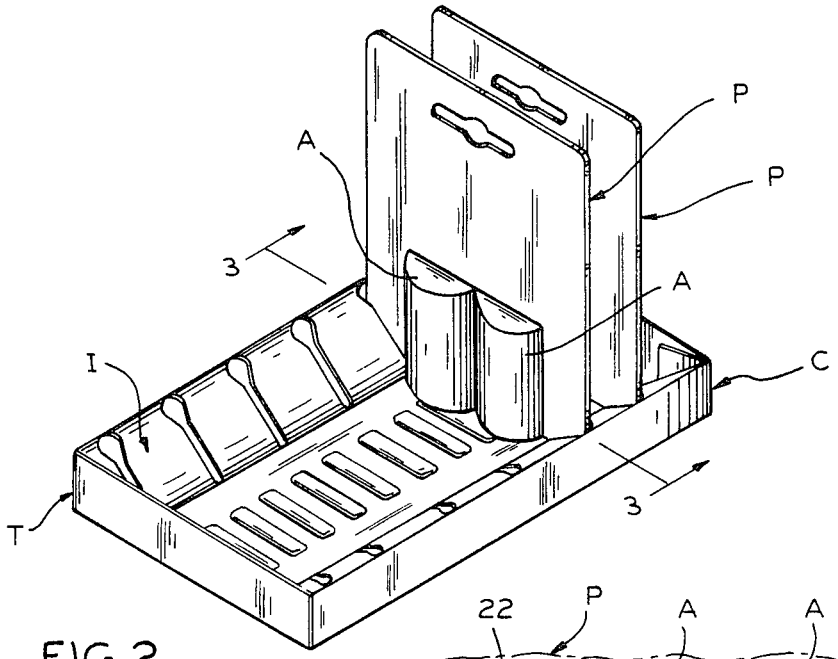
FIG. 2 is a perspective view of a carton formed from the blank illustrated in FIG. 1 and embodying features of the present invention, as shown holding carded packages.

Turning now to the drawings for a better understanding of the invention, and particularly to FIG. 2, it will be seen that the invention includes a carton C having a tray, indicated generally at T, with an integral internal partition structure, indicated generally at I. The tray and partition structure are adapted to hold in place in an upright position a plurality of carded packages, indicated generally at P each of which includes a card have a plurality of articles, such as storage batteries A, attached thereto by a plastic blister, shrink-film, or some similar means.

Figure 1:
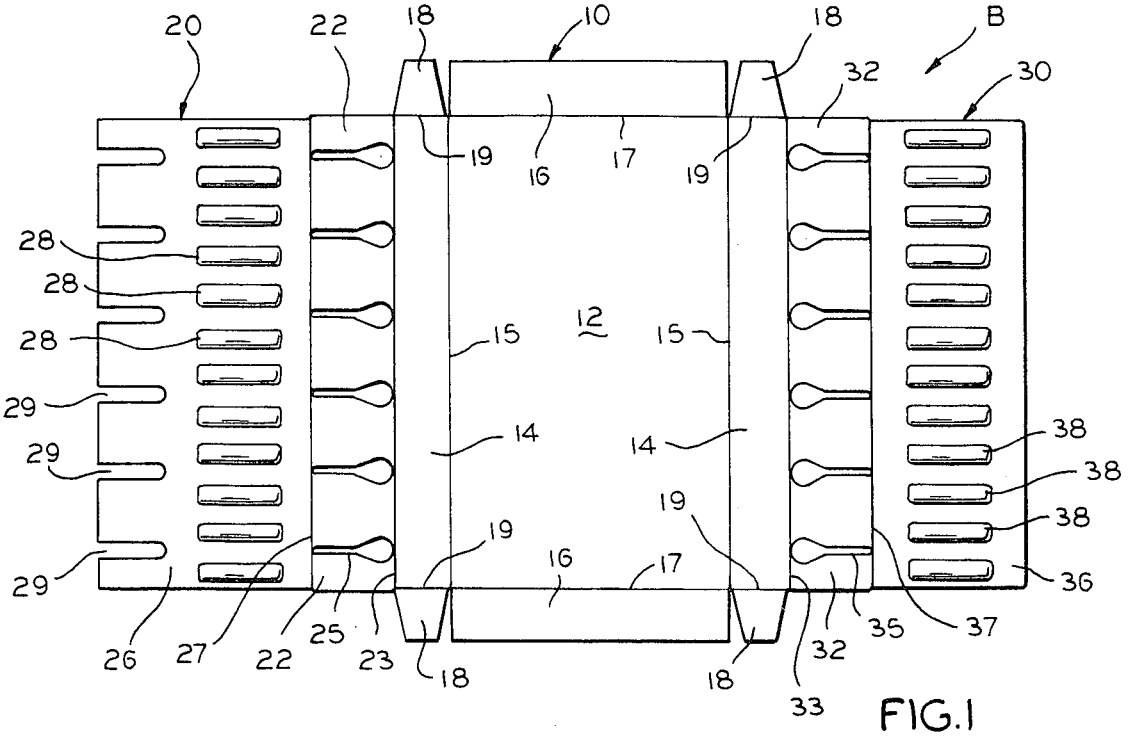
FIG. 1 is a plan view of a blank of foldable sheet material from which the carton illustrated in the other views may be formed.

Still referring to FIGS. 2, it will be seen that the carton C may be formed from the unitary blank B of foldable sheet material, such as paperboard, illustrated in FIG. 1.

The carton blank comprises a central tray portion, indicated generally at 10 which includes a preferably rectangular bottom wall panel 12 having a pair of side wall panels 14 foldably joined to opposite side edges thereof along fold lines 15 and a pair of end wall panels 16 foldably joined to opposite end edges thereof along fold lines 17. Each of the side wall panels 14 has foldably joined to the opposite end thereof, on fold lines 19, corner flaps 18 which may be folded at right angles to the side wall panels and secured to the adjacent portions of related end wall panels 16 in a conventional manner.

In addition to the tray portion of the blank, there is an internal partition structure which includes separate sections 20 and 30 disposed on opposite sides of the tray portion.

Section 20 includes a first inclined panel 22 which is foldably joined at its outer edge on fold line 23 to the upper edge of related tray side wall panel 14. Panel 22 is provided with a plurality of generally parallel, transversely extending, keyhole-shaped slots 25 which are adapted to cooperate with similar slots in the opposite inclined panel to receive lower portions of carded packages.

Figure 3:
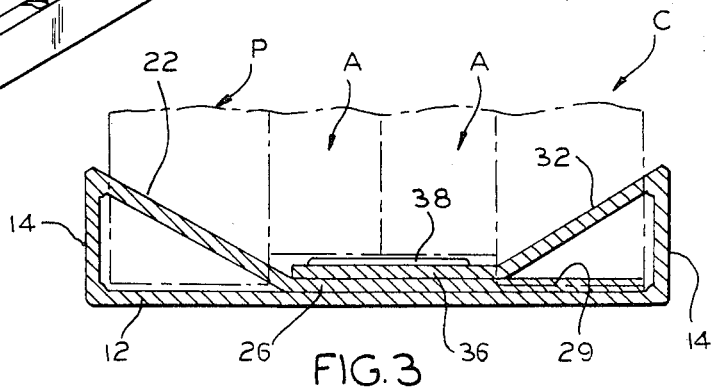
FIG. 3 is a fragmentary, transverse, vertical, sectional view taken on line 3—3 of the structure illustrated in FIG. 2.

Structure 20 also includes a lower bottom panel 26 which is foldably joined along fold lines 27 to the lower edge of side panel 22 and which is disposed to lie in face-to-face relation with the upper surface of tray bottom wall panel 12 and extend substantially all of the way from the lower end of side panel 22 to the opposite tray side wall panel 14. Lower bottom panel 26 includes a plurality of longitudinally spaced, embossed or raised central portions 28 which extend transversely across the tray in parallel relation with each other and with the end wall panels 16 of the tray. At its free edges, lower bottom panel 26 presents a plurality of inwardly extending parallel notches 29 which are adapted to receive lower portions of the carded packages, as indicated in FIG. 3.

The integral partition structure also includes another similar section, indicated generally at 30, which includes a side panel 32 foldably joined on a fold line 33 to the upper edge of the other tray side wall panel 14.

Panel 32 is similar to the previously described side panel 22 and is disposed to extend downwardly toward the bottom wall of the tray. Panel 32 includes a plurality of transversely extending keyhole-shaped slots 35.

Foldably joined along fold line 37 to the lower edge of side panel 32 is an upper bottom panel 36 which is disposed to extend inwardly from the lower edge of side panel 32 over the central portion of lower bottom panel 26. Upper bottom panel 36 is also provided with a plurality of transversely extending, longitudinally spaced embossed or raised portions 38 which match with the corresponding raised portions 28 of the lower bottom panel 26.

The purpose of the raised portions 26 and 36 in the upper and lower bottom panels of the partition structure and the purpose of the notches 29 in the lower bottom panel is to provide a means for stabilizing the carded packages to insure that they fit firmly and solidly in the partition structure of the tray and not tip over when the tray is used as a display.

The raised portions on the partition structure bottom panels cushion and firmly engage the lower portions of the packaged articles, as best seen in FIG. 3, and the notches in the lower bottom panel permit the lower edges of the packaging cards to extend all the way down to and engage the upper surface of the tray bottom wall panel. Thus, the carded packages are maintained in an upright position while being held in the novel tray carton of the invention.

What is claimed is:

1. A carton for displaying a plurality of packages, each including one or more articles secured to a face of a card adjacent the lower end thereof, said carton being formed from a unitary blank of foldable sheet material, such as paperboard, and comprising:

(a) a tray including a bottom wall panel and pairs of opposed side and end wall panels foldably joined to each other and to side and end edges of said bottom wall panel and upstanding therefrom;

(b) an integral partition structure including:

(i) a pair of opposed, inclined side panels foldably joined to upper edges of respective tray side wall panels and sloping downwardly and inwardly therefrom toward said tray bottom wall panel and presenting longitudinally spaced, transversely extending parallel slots aligned with each other to receive opposite side portions of said package cards;

(ii) upper and lower bottom panels foldably joined to the lower ends of said side panels and disposed adjacent said tray bottom wall panel;

(c) at least one upper bottom panel having a plurality of longitudinally spaced, raised central portions for supporting said packaged articles;

(d) at least one lower bottom panel having a plurality of longitudinally spaced notches extending inwardly from a free edge thereof to receive adjacent lower corner portions of said cards to allow said cards to rest on said tray bottom wall panel and thereby stabilize the cards.

2. A carton according to claim 1, wherein said partition structure side panel slots are generally keyhole-shaped with wider portions at the upper ends thereof.

3. A carton according to claim 1, wherein said upper and lower bottom panels extend inwardly from respective side panels and are disposed in partially overlapped relation.

4. A carton according to claim 3, wherein said lower bottom panel includes a portion which extends beyond said upper bottom panel and contains said notches.

5. A carton for displaying a plurality of packages, each including one or more articles secured to a face of a card adjacent the lower end thereof, said carton being formed from a unitary blank of foldable sheet material, such as paperboard, and comprising:

(a) a tray including a bottom wall panel and pairs of opposed side and end wall panels foldably joined to each other and to side and end edges of said bottom wall panel and upstanding therefrom;

(b) an integral partition structure including:

(i) a pair of opposed, inclined side panels foldably joined to upper edges of respective tray side wall panels and sloping downwardly and inwardly therefrom toward said tray bottom wall panel and presenting longitudinally spaced, transversely extending, parallel slots aligned with each other to receive opposite side portions of said package cards;

(ii) uper and lower bottom panels foldably joined to the lower ends of respective said side panels and disposed adjacent said tray bottom wall panel;

(c) said upper bottom panel having a plurality of longitudinally spaced, raised central portions for supporting said packaged articles;

(d) said lower bottom panel having a plurality of longitudinally spaced notches extending inwardly from a free edge thereof to receive adjacent lower corner portions of said cards to allow said cards to rest on said tray bottom wall panel and thereby stabilize the cards.

* * * * *